US008342648B2

(12) United States Patent
Muraoka et al.

(10) Patent No.: US 8,342,648 B2
(45) Date of Patent: Jan. 1, 2013

(54) INKJET HEAD

(75) Inventors: Chiaki Muraoka, Kawaguchi (JP); Yasushi Iijima, Tokyo (JP); Tomotsugu Kuroda, Yokohama (JP); Naoko Tsujiuchi, Kawasaki (JP); Mikiya Umeyama, Tokyo (JP); Masaki Oikawa, Inagi (JP); Yuichiro Akama, Tokyo (JP); Keiji Tomizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 12/892,228

(22) Filed: Sep. 28, 2010

(65) Prior Publication Data

US 2011/0074884 A1 Mar. 31, 2011

(30) Foreign Application Priority Data

Sep. 30, 2009 (WO) ..... PCT/JP2009/066993

(51) Int. Cl.
*B41J 2/21* (2006.01)

(52) U.S. Cl. ..... 347/43

(58) Field of Classification Search ..... 347/12, 347/15, 40, 43, 47
See application file for complete search history.

(56) References Cited

U.S. PATENT DOCUMENTS

| | | | |
|---|---|---|---|
| 6,976,748 | B2 | 12/2005 | Yabe |
| 7,434,917 | B2 | 10/2008 | Iijima |
| 2008/0030545 | A1 | 2/2008 | Iijima |

FOREIGN PATENT DOCUMENTS

| | | | |
|---|---|---|---|
| JP | 1-195051 | A | 8/1989 |
| JP | 2004-01491 | A | 1/2004 |
| JP | 2006-224444 | A | 8/2006 |
| JP | 2008-036960 | A | 2/2008 |
| JP | 2008-049533 | A | 3/2008 |
| JP | 2009-166257 | A | 7/2009 |

*Primary Examiner* — Lamson Nguyen
(74) *Attorney, Agent, or Firm* — Canon USA Inc IP Division

(57) ABSTRACT

To provide an inkjet head which includes high-density nozzle rows and which does not easily cause an ejection failure due to adhesion of ink mist around ejection orifices when a high-density image of a secondary color is printed with a small number of paths. An inkjet head includes at least two or more types of nozzle rows that eject different amounts of ink. When A is the cross section, with respect to an ink supplying direction, of an ink supply path from each ejection orifice to a supply port and L is the length of the ink supply path, the value of A/L differs between the two or more types of nozzle rows. The nozzle row of which the value of A/L is small is disposed outside an area between the nozzle rows that eject a largest amount of ink and that are arranged next to each other.

9 Claims, 10 Drawing Sheets

INKJET HEAD

BACKGROUND OF THE INVENTION

1. Field of the Invention

The present invention relates to an inkjet head that ejects ink toward a recording medium, such as paper, through an ejection orifice.

2. Description of the Related Art

In inkjet heads that perform recording by ejecting ink through ejection orifices, reduction in costs and high-speed printing have been demanded. The cost of an inkjet head can be effectively reduced by reducing the size of the head, in particular, by reducing the size of a recording element substrate. The printing speed can be effectively increased by densely arranging many nozzles in a single recording element substrate.

Photolithography has been developed in which a photosensitive resin is used as the material of a component for forming ejection orifices and flow paths. The surface of the component is selectively exposed to light by using a photo mask, and then a developing process is performed. By using advanced photolithography, it has become possible to form high-precision, high-resolution nozzles. For example, it has become possible to form a nozzle structure described in Japanese Patent Laid-Open No. 2008-49533 by a nozzle forming method using photolithography.

It has been found that the following problems occur when high-speed printing is performed using a head in which nozzles are arranged at a high density.

FIG. 7 is a diagram illustrating an example of a nozzle structure of an inkjet head in which nozzles are arranged at a high density. An ejection amount of nozzle rows C1, M1, Y1, and Y2 is about 5 pl, an ejection amount of nozzle rows C2 and M2 is about 2 pl, and an ejection amount of nozzle rows C3 and M3 is about 1 pl. Here, C, M, and Y represent nozzles that eject cyan ink, magenta ink, and yellow ink, respectively. The arrangement density of the nozzle rows with the ejection amount of 5 pl in an arrangement direction is 600 dpi, and the arrangement density of the nozzles with the ejection amounts of 2 pl and 1 pl in the arrangement direction is 600 dpi. In other words, the nozzles with the ejection amounts of 2 pl and 1 pl are arranged at a density of 1,200 dpi.

A process of recording a high-density solid red image in a single pass was repeated a plurality of times using the above-described inkjet head. More specifically, all of the nozzles in the nozzle rows Y1, Y2, and M1 with the ink ejection amount of 5 pl were used and the image was recorded with the recording density of 600 dpi/75% duty in a carriage scanning direction. All of the nozzles in the inkjet head were subjected to print check immediately after the above-described recording process. As a result, an ejection failure occurred at a plurality of nozzles in the nozzle row M3.

An ejection orifice surface around the nozzle row M3 at which the ejection failure occurred was observed, and it was found that many small ink droplets, that is, so-called ink mist, have adhered to the ejection orifice surface, as shown in FIG. 8. A solid image with a lower image density (for example, image density of 600 dpi/25% duty in the carriage scanning direction) was also printed. In this case, the amount of ink mist adhered to the ejection orifice surface was small, and the ejection failure did not occur.

Thus, high-density images of secondary and tertiary colors were printed using the inkjet head in which a plurality of nozzle rows, which each include densely arranged nozzles, are arranged in a small area. As a result, it was found that a large amount of ink mist adhered to the ejection orifice surface, and the ejection failure was caused by the ink mist.

The above-described problem can be solved by, for example, reducing the print density for a single carriage scanning operation. However, in such a case, the number of times the carriage scanning operation is repeated must be increased to print a high density image. As a result, the printing time increases. In addition, the above-described problem can also be solved by cleaning the ejection orifice surface before the amount of ink mist on the ejection orifice surface reaches a certain amount. However, in this case, the number of times the cleaning process is performed and the time required for cleaning are increased. Therefore, also in this case, the printing time increases.

In light of the above-described situation, an object of the present invention is to provide an inkjet head in which nozzles are densely arranged and which does not easily cause the ejection failure due to the adhesion of ink mist around the ejection orifices even when a high-density image of, for example, a secondary color is printed with a small number of repetitions of the carriage scanning operation.

SUMMARY OF THE INVENTION

To solve the above-described problems, an inkjet head according to the present invention includes nozzles and supply ports, each nozzle including an ejection orifice through which ink is ejected and a flow path which communicates with the ejection orifice, and each supply port communicating with a plurality of the flow paths. A first nozzle row, a second nozzle row, and a third nozzle row are arranged next to each other, the first nozzle row including a plurality of the nozzles that eject ink of a first color, the second nozzle row including a plurality of the nozzles that eject ink of a second color, and the third nozzle row including a plurality of the nozzles that eject ink of a third color. At least one of the first to third nozzle rows include a large nozzle row and a small nozzle row, the large nozzle row including a plurality of the nozzles that eject a relatively large amount of ink and the small nozzle row including a plurality of the nozzles that eject a relatively small amount of ink. When A is the average cross section along a direction perpendicular to an ink supplying direction of a liquid path from each supply port to each ejection orifice and L is the length of the liquid path in the ink supplying direction, the nozzle row of which the value of A/L is smallest of the plurality of nozzle rows is disposed outside an area between the large nozzle rows that are arranged next to each other.

Further features of the present invention will become apparent from the following description of exemplary embodiments with reference to the attached drawings.

DESCRIPTION OF THE EMBODIMENTS

First Embodiment

Figure 5:
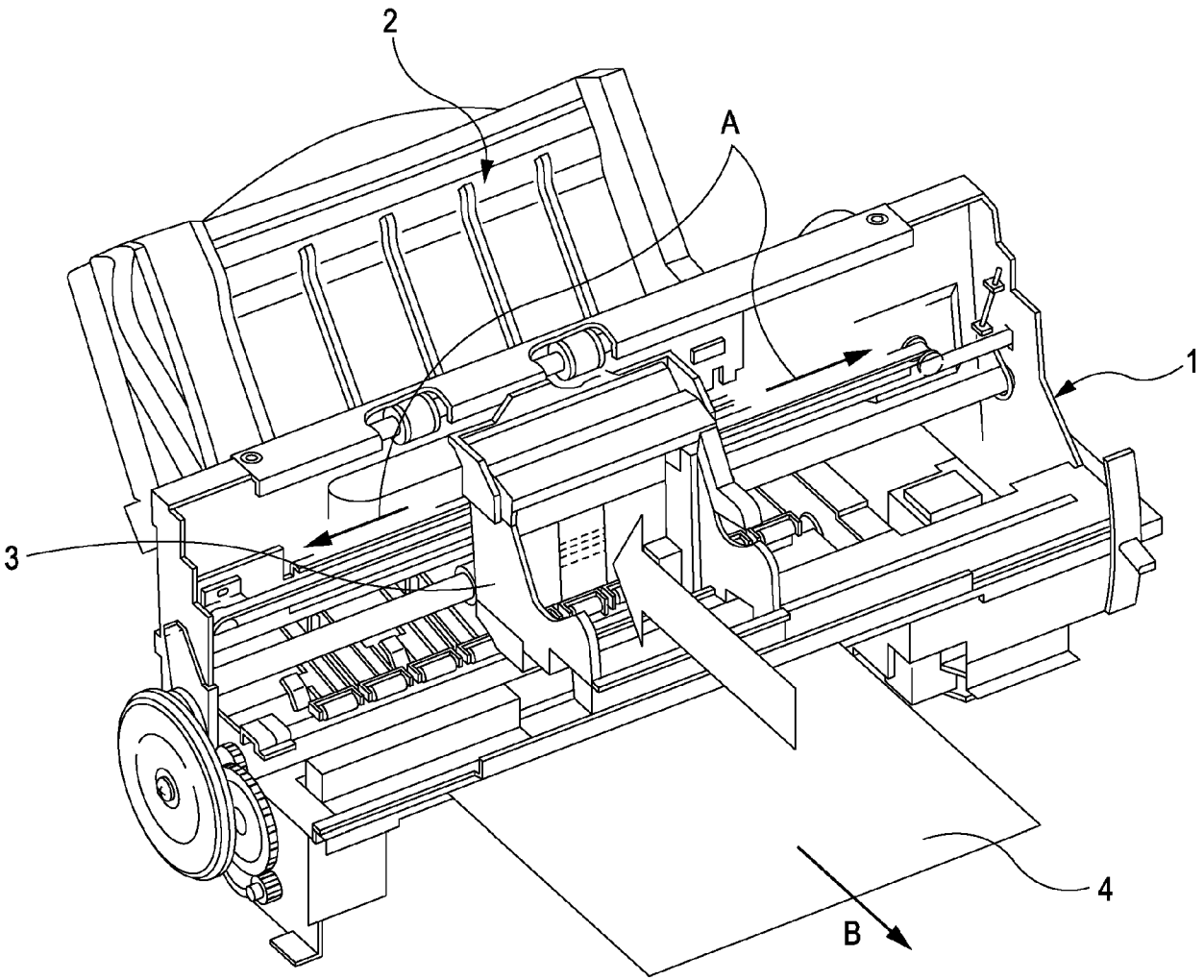
FIG. 5 illustrates the structure of a recording apparatus in which the inkjet head according to the present invention is mounted.

FIG. 5 is a schematic diagram illustrating the structure of a recording apparatus in which the present invention is incorporated. A printer body includes a housing 1, a carriage 3 that reciprocates along a certain direction, a sheet feeding mechanism 2 that feeds a recording sheet 4, and a sheet ejecting mechanism (not shown) that ejects the recording sheet 4 after an image is recorded thereon.

The recording sheet 4 is conveyed in a direction shown by the arrow B that is perpendicular to a carriage scanning direction (hereinafter referred to as a recording scanning direction) shown by the arrows A.

An inkjet head 5 is mounted on the carriage 3, and is fixed and supported in a certain state by positioning means and electrical contacts.

Figure 6:
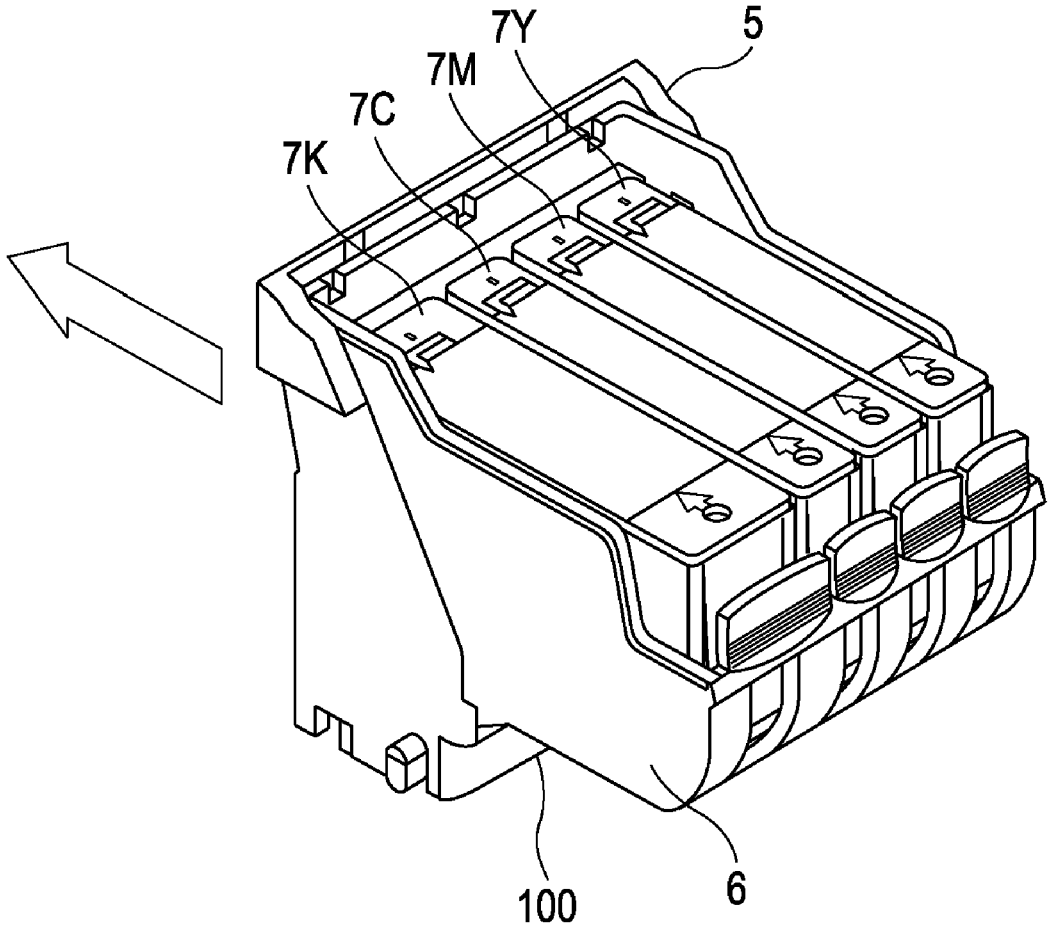
FIG. 6 illustrates the external structure of the inkjet head according to the present invention.
Figure 7:
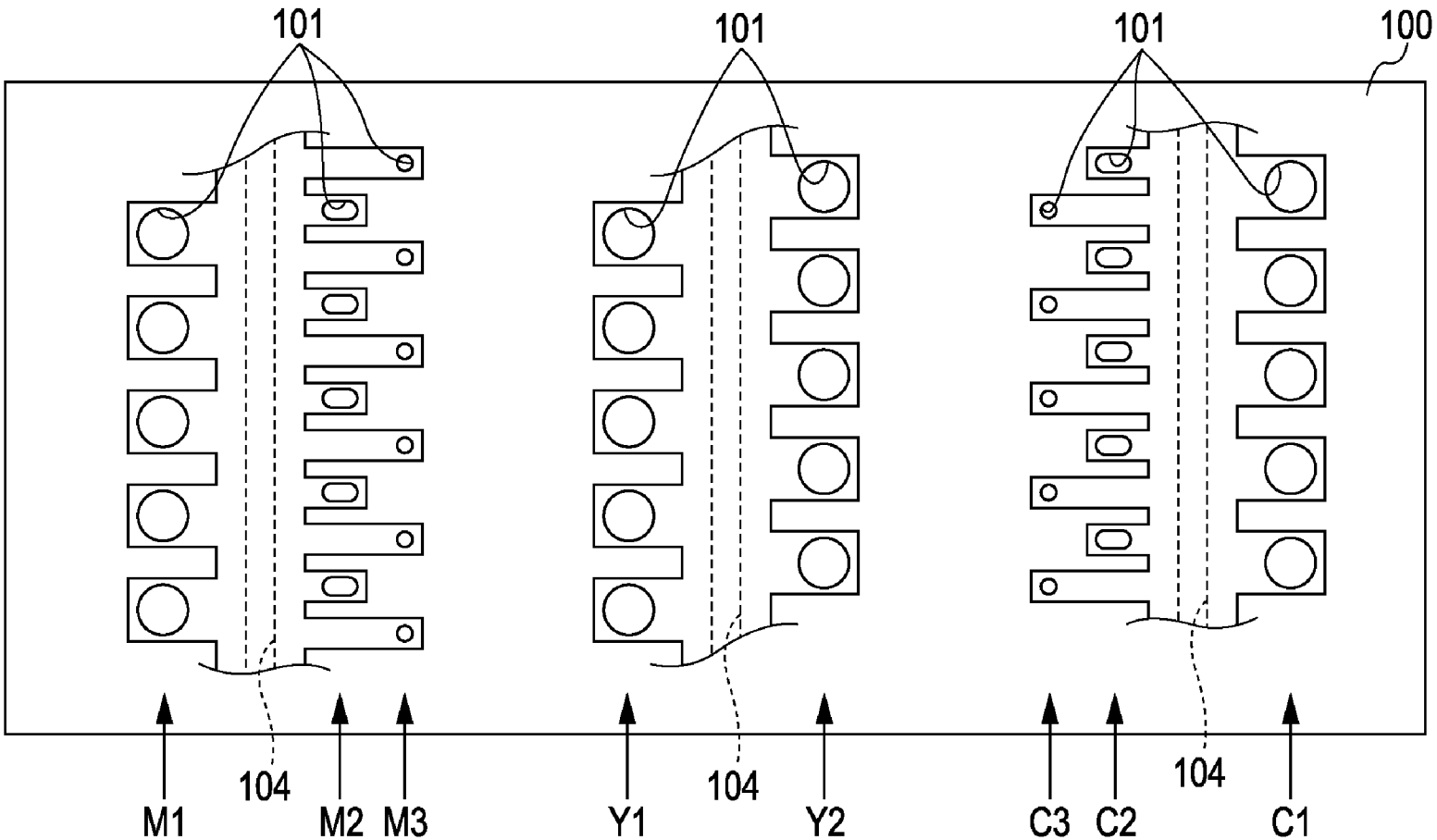
FIG. 7 illustrates an example of a nozzle structure of an inkjet head of a related art.
Figure 8:
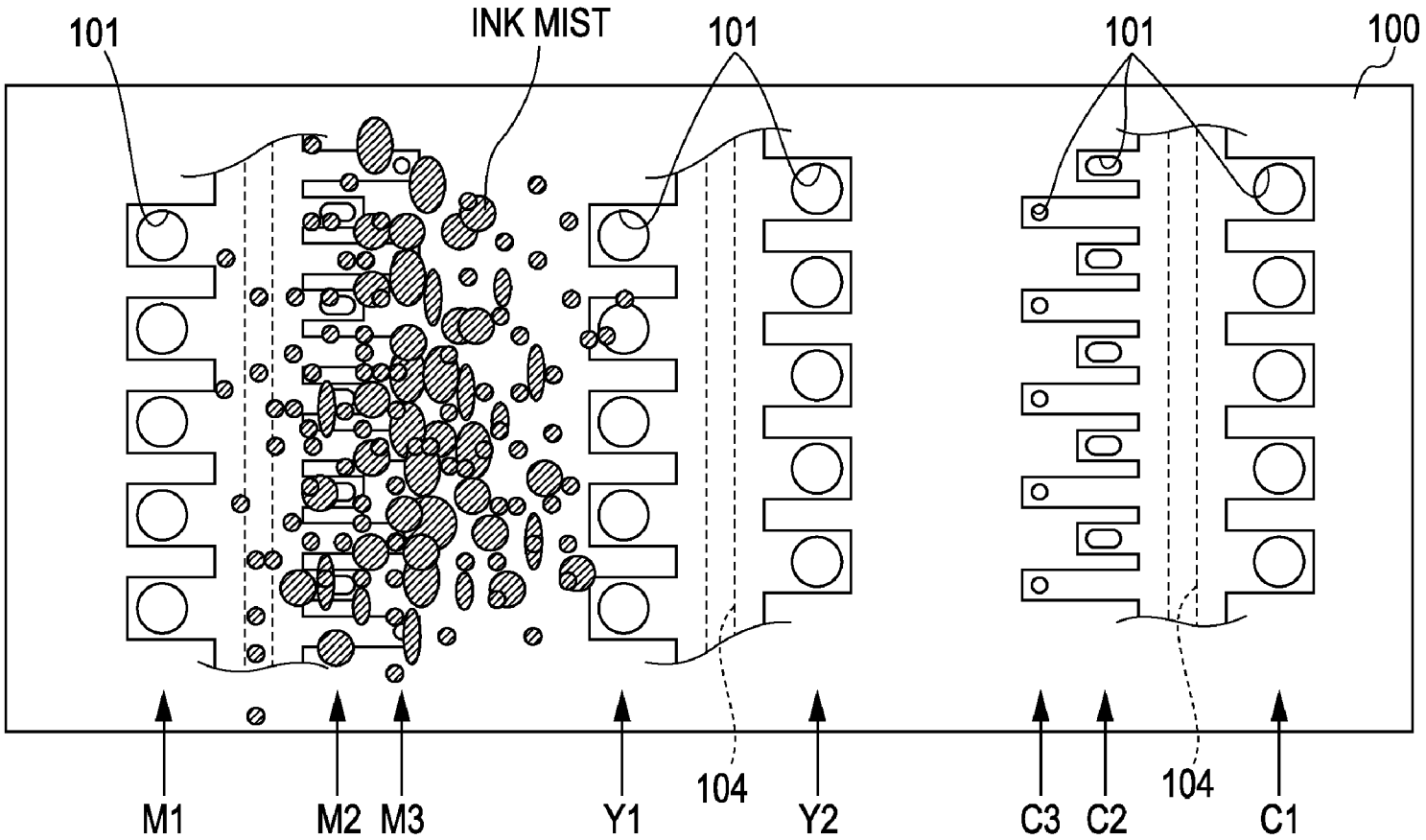
FIG. 8 illustrates the state of an ejection surface after solid-image printing is performed using the inkjet head of the related art.

The structure of the inkjet head 5 is illustrated in FIG. 6. The inkjet head 5 includes a recording element substrate 100 that ejects color ink (cyan, magenta, and yellow), a recording element substrate 100 that ejects black ink, and a tank holder 6. The inkjet head 5 can receive a tank 7K of black ink, a tank 7C of cyan ink, a tank 7M of magenta ink, and a tank 7Y of yellow ink, and includes flow paths for transferring the ink contained in the ink tanks to the recording element substrates 100.

Each recording element substrate 100 is provided with a plurality of nozzles, and ejects ink toward the recording sheet 4 while moving together with the carriage 3 in a direction perpendicular to a sheet ejecting direction. The nozzles are portions through which the ink flows from supply ports 104 to ejection orifices 101, that is, portions which each include an ejection orifice, a pressure chamber, and a flow path. The ink is ejected from each nozzle at a predetermined timing in accordance with recording data received though the electrical contacts provided in the carriage 3, so that a predetermined image can be recorded. The sheet ejecting mechanism conveys the recording sheet 4 fed from the sheet feeding mechanism 2 by an adequate amount in synchronization with the movement of the carriage 3, guides an image forming operation performed by the inkjet head 5, and finally ejects the sheet on which the image has been recorded to the outside of the housing.

Figure 1:
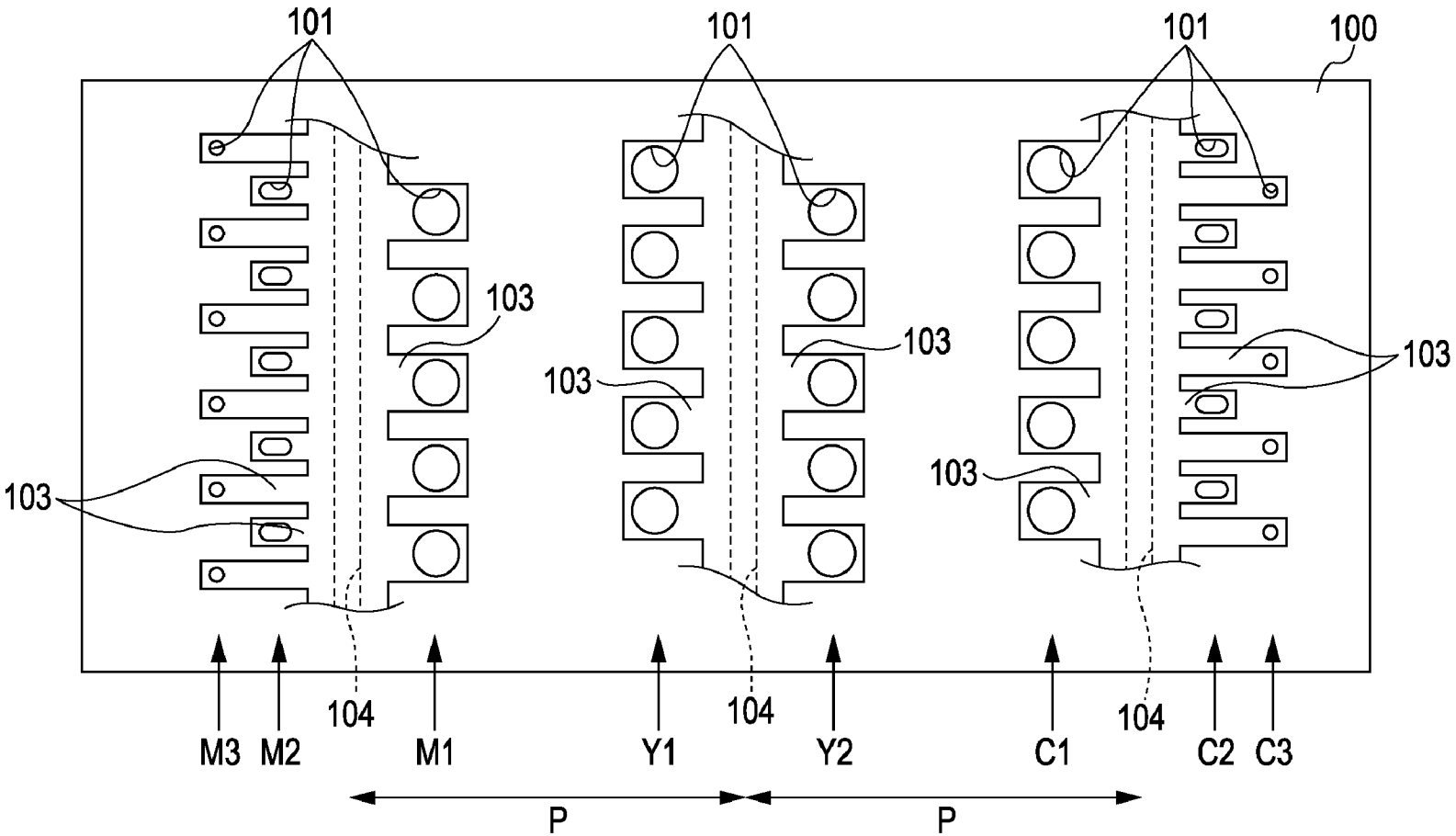
FIG. 1 illustrates a recording element substrate according to a first embodiment of the present invention.

The structure of the nozzles will now be described. FIG. 1 is a diagram illustrating a part of an area in which the nozzles are formed in the recording element substrate 100. First nozzle rows M1, M2, and M3 that eject magenta ink, which is ink of a first color, second nozzle rows Y1 and Y2 that eject yellow ink, which is ink of a second color, and third nozzle rows C1, C2, and C3 that eject cyan ink, which is ink of a third color, are arranged next to each other in the recording element substrate 100. With regard to the nozzle rows that eject magenta ink and cyan ink, a nozzle row that ejects large droplets is arranged at one side of each supply port 104, and nozzle rows that eject intermediate and small droplets are arranged at the other side of the supply port 104.

The supply ports 104 are provided for each color, and the ink is supplied to the nozzle rows of each color through the corresponding supply port 104 and is ejected from the ejection orifices 101 through flow paths 103 and bubbling chambers 102 (see FIG. 2), which are formed individually.

With regard to intervals P between the nozzle rows of the respective colors, the interval between magenta and yellow and the interval between cyan and yellow are substantially equal to each other, and are about 1.4 mm. An amount of ink ejected from nozzle rows C1, M1, Y1, and Y2 is about 5 pl, an amount of ink ejected from nozzle rows C2 and M2 is about 2 pl, and an amount of ink ejected from nozzle rows C3 and M3 is about 1 pl. In a process of recording a high-density solid image, high-speed recording is performed by causing the nozzle rows C1, M1, Y1, and Y2, which eject the largest amount of ink, to eject the ink at a high density and a high frequency. Accordingly, it is necessary to supply the ink at a high flow rate to the nozzles in the nozzle rows C1, M1, Y1, and Y2. Therefore, the shape, cross section, and length of the flow paths and the shape and size of filter-shaped structures (not shown) provided near the entrances of the flow paths are adjusted so as to reduce the viscosity resistance in the nozzles in the nozzle rows C1, M1, Y1, and Y2.

Figure 2:
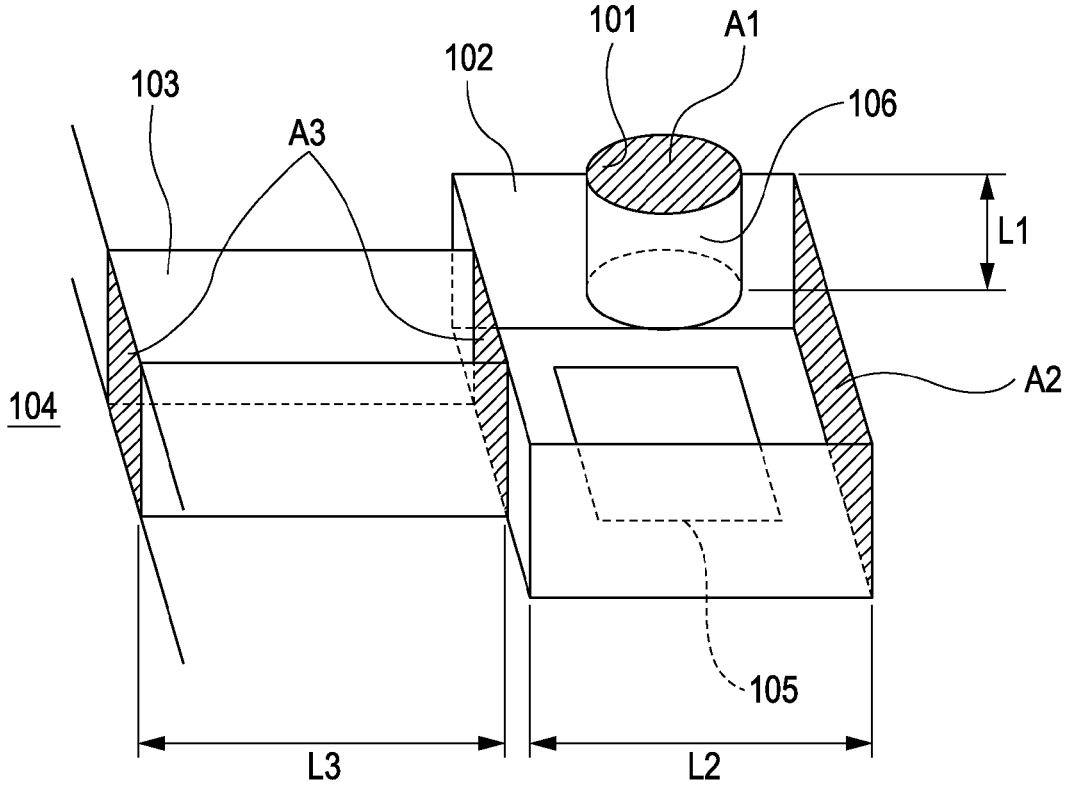
FIG. 2 is a schematic perspective view of a nozzle in which the present invention is incorporated.

FIG. 2 is an enlarged perspective view illustrating the inner structure of a single nozzle. As illustrated in FIG. 2, a heater 105, which is an energy generating element that generates energy used to eject the ink, is provided at a position where the heater 105 faces the ejection orifice 101. The bubbling chamber 102 is formed so as to surround the heater 105. The bubbling chamber 102 is fluidly connected to the supply port 104 through the flow path 103. With this structure, ink can be supplied to each ejection orifice 101 through the corresponding supply port 104. The heater 105 is driven while the bubbling chamber 102 is filled with the ink. Accordingly, bubbles are generated in the bubbling chamber 102 and the ink is ejected from the ejection orifice 101 by the pressure applied by the bubbles.

A portion that extends from the ejection orifice 101 to the bubbling chamber (ejection orifice portion 106) is formed so as to have a cross section A1 that is substantially uniform and a length L1. The bubbling chamber 102 is formed so as to have a cross section A2 that is substantially uniform and a length L2. The flow path 103 is formed so as to have a cross section A3 that is substantially uniform and a length L3.

In FIG. 1, nozzles in the nozzle rows C1, M1, Y1, and Y2 basically have a similar structure, where A1 is about 210 $\mu m^2$, L1 is about 11 μm, A2 is about 390 $\mu m^2$, L2 is about 31 μm, A3 is about 270 $\mu m^2$, and L3 is about 19 μm. In addition, nozzles in the nozzle rows C2 and M2 basically have a similar structure, where A1 is about 99 $\mu m^2$, L1 is about 11 μm, A2 is about 240 $\mu m^2$, L2 is about 46 μm, A3 is about 132 $\mu m^2$, and L3 is about 16 μm. In addition, nozzles in the nozzle rows C3 and M3 basically have a similar structure, where A1 is about 60 $\mu m^2$, L1 is about 11 μm, A2 is about 320 $\mu m^2$, L2 is about 88 μm, A3 is about 140 $\mu m^2$, and L3 is about 67 μm.

Figure 3:
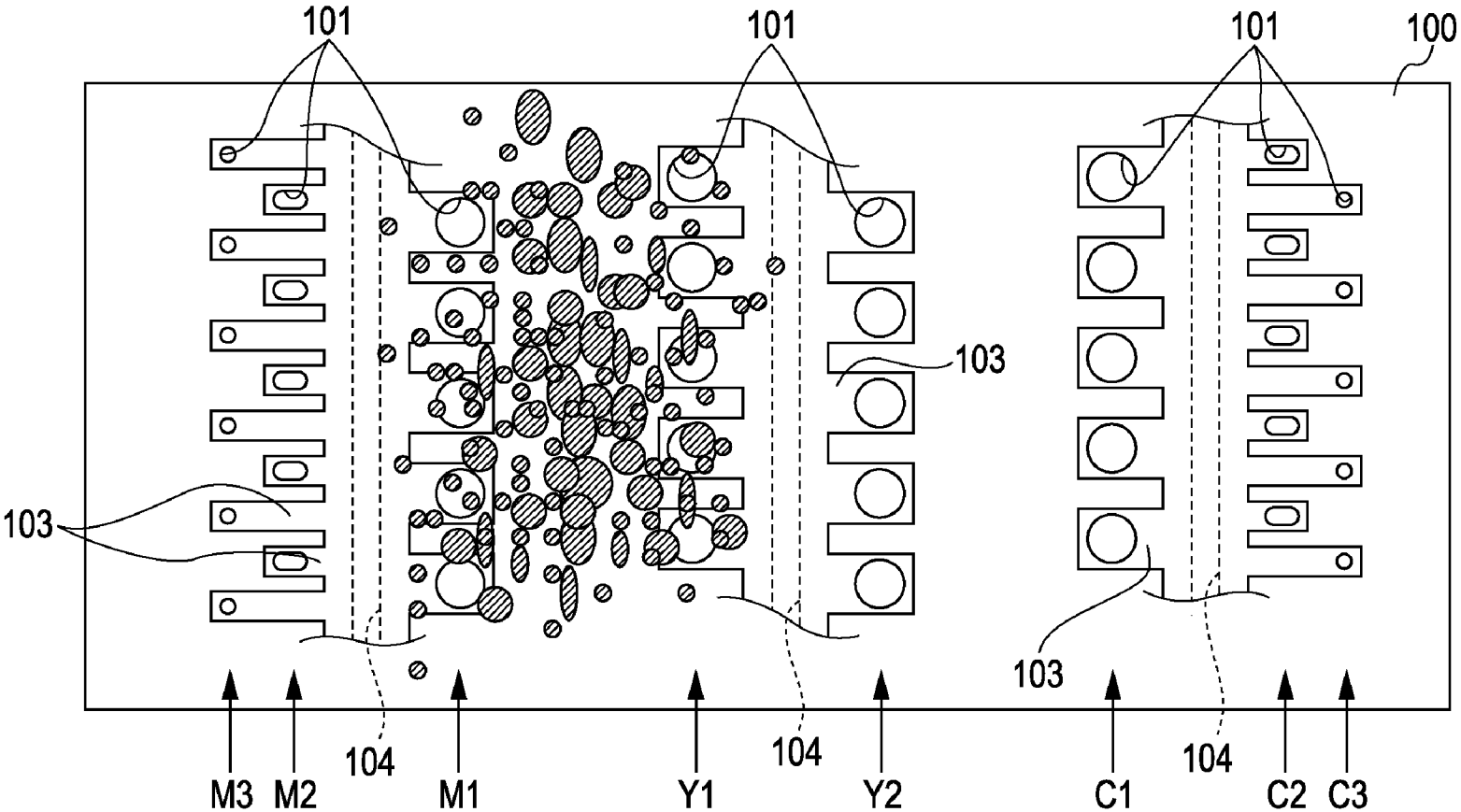
FIG. 3 illustrates the state of an ejection surface after solid-image printing is performed using an inkjet head according to the present invention.

FIG. 3 illustrates the state of the ejection surface immediately after a process of printing a high-density solid red image in a single pass was repeated using the recording element substrate 100 according to the present invention (all of the nozzles in the nozzle rows Y1, Y2, and M1 were used and the recording density was 600 dpi/75% duty in a carriage scanning direction). It was found that a large amount of ink mist adhered to the surface in an area between the nozzle rows M1 and Y1. However, no ejection failure occurred in any of the nozzles even immediately after printing over the entire area of an A4-size sheet, and it was confirmed that the printing operation can be normally performed.

Figure 10:
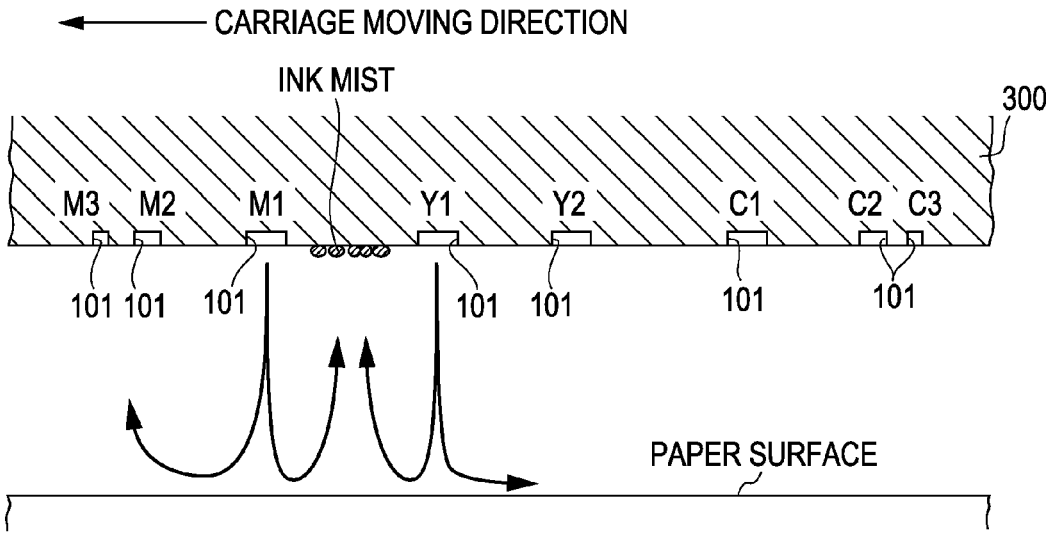
FIG. 10 illustrates the manner in which the ink mist that adheres to the ejection surface flows.

The adhesion of the ink mist on the ejection surface probably occurs because of the following reasons. That is, in the case where high-density printing of a secondary color is performed using yellow and magenta ink, if high-density ink ejection is performed by each of nozzle rows that are close to each other with a predetermined distance therebetween, airflows are generated in a vertically downward direction (direction toward the recording sheet), owing to the ejection of the ink from each nozzle row. The airflows generated by the ejection of the ink from each nozzle row encounter each other in an area near the sheet, thereby forming a strong swirl in a vertically upward direction (see FIG. 10). Accordingly, some of the ink droplets ejected from the ejection orifices 101 that have small diameters or that are ejected at low speeds (ink mist) are caused to travel upward by the swirl and adhere to the ejection orifice surface. The positions where the ink mist adheres to the ejection orifice surface are concentrated in an area between the nozzle rows that perform high-density ink ejection.

Figure 4:
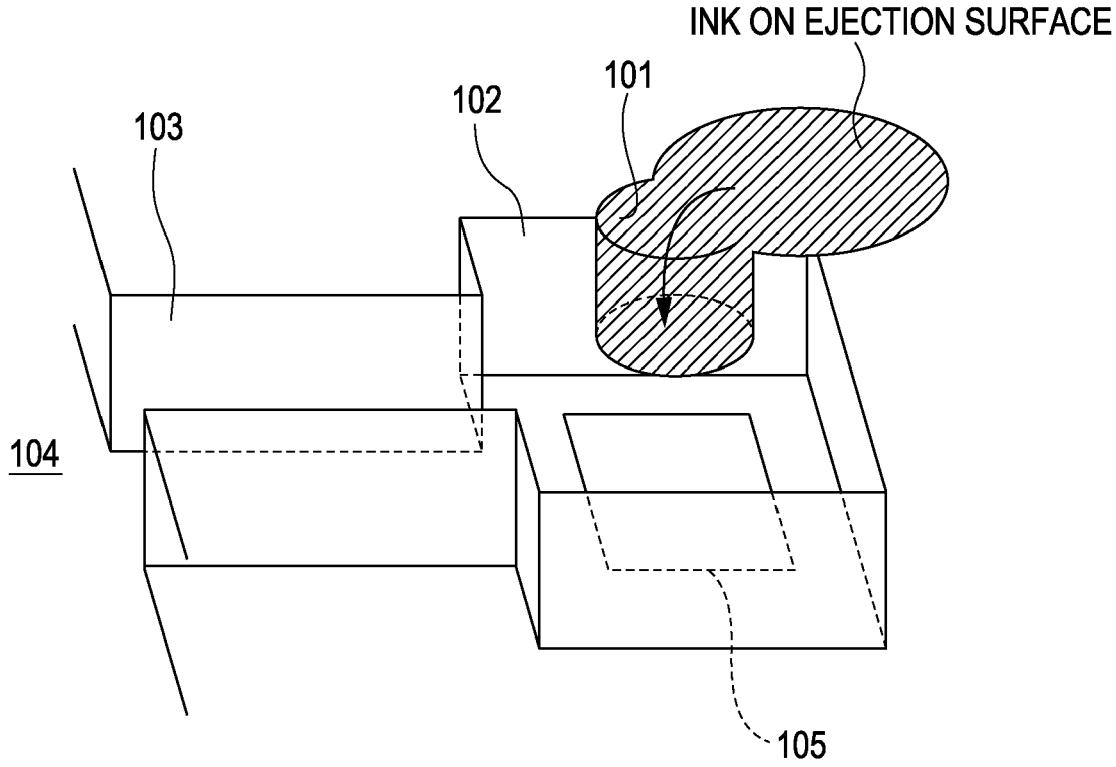
FIG. 4 illustrates the inner structure of a nozzle according to the present invention and the behavior of ink that has adhered to the ejection surface.

The ejection failure due to the adhesion of the mist to the ejection surface described in the Background Art section probably occurs by the following mechanism. That is, when high-density printing of a secondary color is performed using a head in which nozzles are densely arranged, the ink mist adheres to the ejection orifice surface, as described above. The adhesion of the ink continuously occurs during the recording scanning operation, and accordingly the ink mist accumulates and collects on the ejection orifice surface, thereby forming a large collection of ink. If the collected ink expands and reaches the edge of an ejection orifice, the ink on the ejection orifice surface flows into the nozzle through the ejection orifice (refer to FIG. 4 in the following description).

In this case, during the time from when the ink is ejected to when the ink flows into the nozzle, the moisture in the ink continuously evaporates. Therefore, the ink that flows into the nozzle has a higher viscosity compared to that of the ink in the nozzle. When the heater 105 is driven after the ink with the increased viscosity has flowed into the ejection orifice, the resistance in a section in front of the heater 105 (section near the ejection orifice) is higher than that in a normal state. Therefore, there is a risk that the ink cannot be ejected. Even if the ink can be ejected, there is a possibility that the ejection direction will be tilted or the ejection speed will be reduced.

However, after the ink with the increased viscosity has flowed into the nozzle through the ejection orifice, moisture is supplied to (dissipates into) the ink with the increased viscosity from the supply port 104 with time, so that the viscosity of the ink gradually decreases. Therefore, if the moisture dissipation occurs instantaneously, the ejection state immediately returns to the normal state and substantially no adverse influence is exerted on the printing operation in practice. If it takes a relatively long time for the moisture to dissipate, the state in which the viscosity of the ink in the section in front of the heater 105 is high is maintained for a certain time interval. Therefore, there is a possibility that the state in which the normal ejection cannot be performed will continue.

According to the above-described mechanism, in the case where the ink with the increased viscosity flows into the ejection orifice from the ejection orifice surface, the speed at which the viscosity of the ink that flows into the ejection orifice decreases is increased as the distance from the supply port 104 to the ejection orifice 101 is reduced, that is, as the dissipation distance is reduced. In addition, the speed at which the viscosity of the ink that flows into the ejection orifice decreases is increased and the time required to restore the normal ejection state is reduced as the cross section of the path through which the moisture dissipates is increased.

In the nozzle structure illustrated in FIG. 2, Q is defined as follows:

$$Q=(A1/L1)+(A2/L2)+(A3/L3) \quad (1)$$

As the value of Q is increased, the adverse influence of the entrance of the ink with the increased viscosity is reduced. In other words, it can be said that nozzles of which the value of Q is small are vulnerable to the entrance of the ink with the increased viscosity. This is because the speed at which the viscosity of the ink decreases is reduced as the cross section of the path is reduced and as the length of the path is increased.

In the recording element substrate 100 according to the embodiment of the present invention, the value of Q of the nozzle rows C1, M1, Y1, and Y2, which eject relatively large droplets, is about 45.9. In contrast, the value of Q of the nozzle rows C2 and M2, which eject relatively small droplets, is about 22.5, and the value of Q of the nozzle rows C3 and M3, which eject the smallest droplets, is about 11.2. Thus, the values of Q of the nozzle rows satisfy the relationship (C1, M1, Y1, Y2)>(C2, M2)>(C3, M3). In the present embodiment, the nozzles of which the value of Q is small are arranged outside the area between the nozzle rows that eject large droplets during printing of a secondary color, that is, outside the area in which the ink mist easily adheres to the ejection orifice surface.

More specifically, the nozzle rows M2 and M3, of which the values of Q are small, are disposed outside the area in which the nozzle rows Y1, Y2, and M1 are arranged. In particular, the nozzle row M3, of which the value of Q is smallest, is disposed at a position farthest from the above-described area.

More specifically, the average cross section along a direction perpendicular to the ink supplying direction of an area (liquid path) from each supply port 104 to each ejection orifice 101 is defined as A, and the length of the area (liquid path) in the ink supplying direction is defined as L. In this case, in the array of the nozzle rows, the nozzle rows of which the value of A/L is smallest are arranged outside the area between the nozzle rows with the largest ejection amount that are arranged next to each other. In the present embodiment, the nozzle rows of which the value of A/L is smallest are arranged at the ends of the array of the nozzle rows in the direction that crosses the nozzle rows.

With this structure, even when the high-density recording scanning operation for the secondary color is repeatedly performed, the ejection failure due to the adhesion of the ink mist to the ejection surface does not easily occur. Although a case in which a red-based solid image is formed as an image of a secondary color by using magenta and yellow ink is explained in the present embodiment, a similar effect can also be obtained when a blue-based solid image is formed by using yellow and cyan ink. More specifically, the influence of the ink with the increased viscosity can be reduced by arranging the nozzle rows C2 and C3 outside the area between the nozzle row C1 and the nozzle rows Y1 and Y2, and arranging the nozzle row C3, of which the value of Q is smallest, at a position farthest from the above-described area.

Second Embodiment

Figure 9:
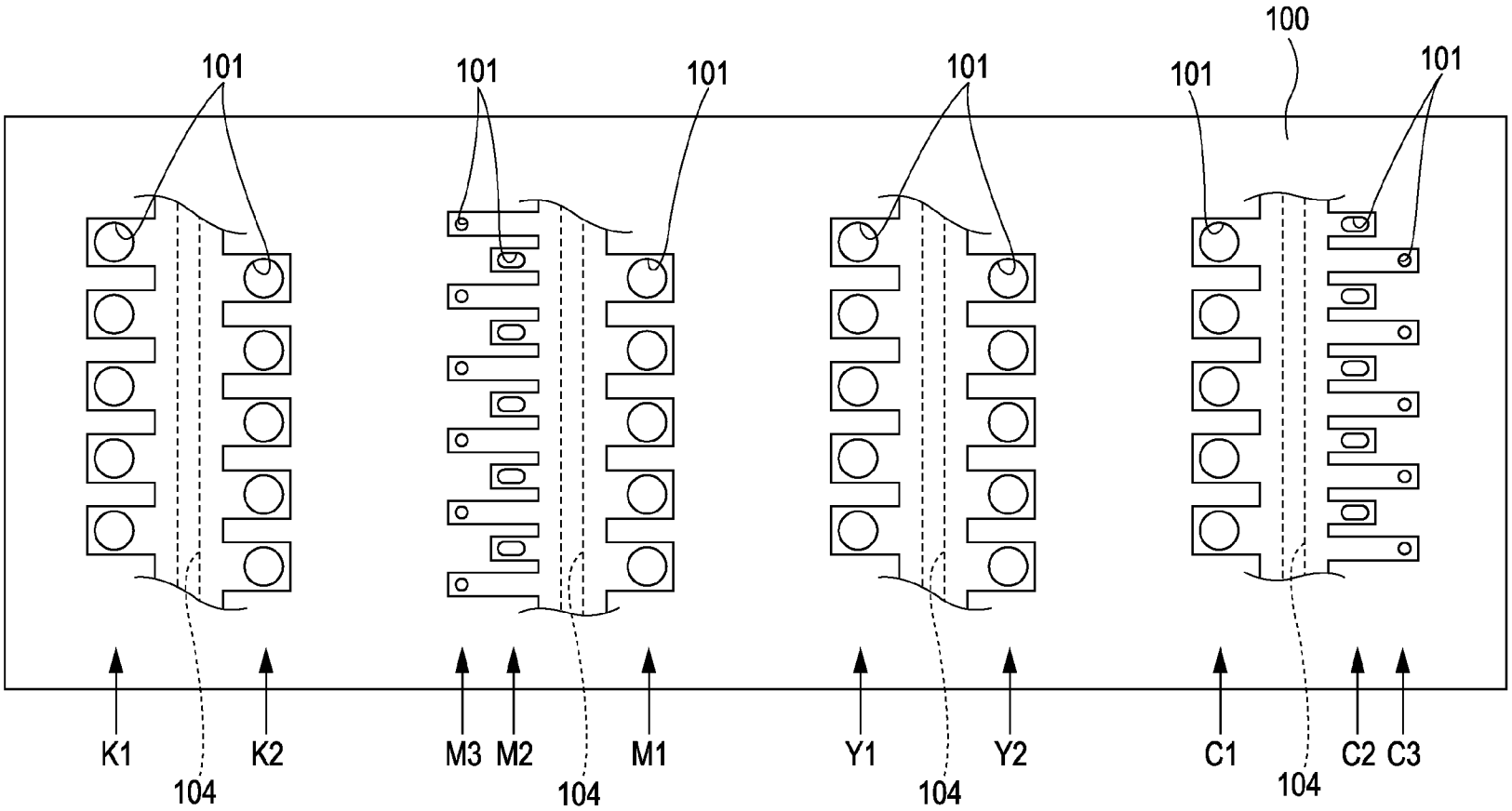
FIG. 9 illustrates the structure of a recording element substrate according to a second embodiment of the present invention.

FIG. 9 illustrates the structure of a second embodiment in which the present invention is incorporated. A recording element substrate 100 according to the present embodiment includes nozzle rows (K1 and K2), which eject black ink that is secondarily used to record a black image, in addition to nozzle rows for ejecting ink of basic colors, which are cyan, magenta, and yellow.

The head having this nozzle structure can eject black ink, and is therefore capable of forming an image with a higher contrast compared to an image formed by a head including only the nozzle rows for the three basic colors (cyan, magenta, and yellow). The black nozzle rows are arranged outside the nozzle rows for the three basic colors. Therefore, in the process of forming an image of a secondary color, the influence of the ink with the increased viscosity that has adhered to the ejection orifice surface can be reduced, as described in the first embodiment.

Similar to the cyan, magenta, and yellow nozzles C1, M1, Y1, and Y2, the ejection amount of the black nozzles K1 and K2 is about 5 pl, and the value of Q thereof is close to that of the cyan, magenta, and yellow nozzles C1, M1, Y1, and Y2. However, the black ink is used as ink of an auxiliary color, and is not used mainly in the process of forming a high-density solid image of a secondary color, unlike the other three basic colors. Therefore, the black ink is not ejected at a high density and a high frequency. Accordingly, even when the nozzle rows K1 and K2 and a nozzle row for another color (nozzle row M1 in the present embodiment) simultaneously eject ink, the strong swirl toward the face surface is not generated and the amount of the ink mist that adheres to the ejection surface is very small. Therefore, no problem occurs even when the nozzle rows M2 and M3 of which the value of Q is small are arranged between the nozzle row M1 and the nozzle rows K1 and K2.

In the above-described embodiment, the small nozzles (M3 and C3) and the intermediate nozzle rows (M2 and C2) in the magenta and cyan nozzle rows are arranged at the same sides of the supply ports 104. However, the present invention is not limited to this. For example, in the magenta and cyan nozzle rows, the large nozzle rows (M1 and C1) and the intermediate nozzle rows (M2 and C2) may be arranged at the same sides of the respective supply ports, while only the small nozzle rows (M3 and C3) are arranged at the other sides of the respective supply ports. Thus, at least the nozzle rows that are easily influenced by the ink with the increased viscosity (the nozzle rows of which the value of Q is small) are disposed outside the area between the large nozzle rows.

The nozzle rows that eject the black ink may be replaced by nozzle rows that eject gray ink. Alternatively, gray nozzle rows may be provided in addition to the black nozzle rows.

In the above-described embodiments, the magenta, cyan, and yellow nozzle rows are arranged in that order in the direction perpendicular to the nozzle rows. However, the order in which the nozzle rows of the respective colors are arranged is not limited to this as long as the above-described relationship regarding the value of Q is satisfied.

In addition, in the above-described embodiment, nozzle rows that eject three types of droplets, which are large droplets, intermediate droplets, and small droplets, are described. However, the present invention is not limited to this, and may also be applied to an inkjet head including nozzle rows that eject two types of droplets, which are large droplets and small droplets.

According to the present invention, even when a high-density image of a secondary or tertiary color is printed using the inkjet head in which nozzles are densely arranged, nozzles with a low flow-path dissipation are not positioned near the area in which the adhesion of ink mist occurs. Therefore, even when the ink mist that has adhered to the surface around the ejection orifices enter the nozzles, the possibility that the ejection failure will occur is low and a normal printing operation can be continuously performed for a long time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/066993, filed Sep. 30, 2009, which is hereby incorporated by reference herein in its entirety.

INDUSTRIAL APPLICABILITY

The present invention is applied to an inkjet head mounted in an inkjet printer that performs recording by ejecting liquid, such as ink, toward a recording medium, such as paper.

What is claimed is:

1. An inkjet head comprising nozzles and supply ports, each nozzle including an ejection orifice through which ink is ejected and a flow path which communicates with the ejection orifice, and each supply port communicating with a plurality of the flow paths, wherein a first nozzle row, a second nozzle row, and a third nozzle row are arranged next to each other, the first nozzle row including a plurality of the nozzles that eject ink of a first color, the second nozzle row including a plurality of the nozzles that eject ink of a second color, and the third nozzle row including a plurality of the nozzles that eject ink of a third color, wherein at least one of the first to third nozzle rows include a large nozzle row and a small nozzle row, the large nozzle row including a plurality of the nozzles that eject a relatively large amount of ink and the small nozzle row including a plurality of the nozzles that eject a relatively small amount of ink, and wherein, when A is the average cross section along a direction perpendicular to an ink supplying direction of a liquid path from each supply port to each ejection orifice and L is the length of the liquid path in the ink supplying direction, the nozzle row of which the value of A/L is smallest of the plurality of nozzle rows is disposed outside an area between the large nozzle rows that are arranged next to each other.

2. The inkjet head according to claim 1, wherein the first nozzle row and the third nozzle row further include intermediate nozzle rows, each of which includes a plurality of the nozzles that eject an amount of ink that is smaller than the amount of ink ejected from the large nozzle row and larger than the amount of ink ejected from the small nozzle row.

3. The inkjet head according to claim 2, wherein, in each of the first and third nozzle rows, the large nozzle row is at one side of the corresponding supply port and the intermediate and small nozzle rows are at the other side of the corresponding supply port.

4. The inkjet head according to one of claim 1, further comprising at least one of a nozzle row that ejects black ink and a nozzle row that ejects gray ink.

5. The inkjet head according to claim 4, wherein the at least one of the nozzle row that ejects black ink and the nozzle row that ejects gray ink is arranged at an end of the array of the plurality of nozzle rows in a direction that crosses the nozzle rows.

6. An inkjet head comprising nozzles and supply ports, each nozzle including an ejection orifice through which ink is ejected and a flow path which communicates with the ejection orifice and each supply port communicating with a plurality of the flow paths, wherein a first nozzle row, a second nozzle row, and a third nozzle row are arranged next to each other such that the second nozzle row is disposed between the first and third nozzle rows in a direction that crosses the nozzle rows, the first nozzle row including a plurality of the nozzles that eject magenta ink, the second nozzle row including a plurality of the nozzles that eject yellow ink, and the third nozzle row including a plurality of the nozzles that eject cyan ink, wherein each of the first and third nozzle rows include a large nozzle row and a small nozzle row, the large nozzle row including a plurality of the nozzles that eject a relatively large amount of ink and the small nozzle row including a plurality of the nozzles that eject a relatively small amount of ink, wherein the second nozzle row includes a plurality of the large nozzle rows, wherein the large nozzle row included in the first nozzle row is arranged next to the large nozzle rows included in the second nozzle row, and the large nozzle row included in the third nozzle row is arranged next to the large nozzle rows included in the second nozzle, and wherein, when A is the average cross section along a direction perpendicular to the ink supplying direction of a liquid path from each support path to each ejection orifice and L is the length of the liquid path in an ink supplying direction, the nozzle rows of which the value of A/L is smallest in the first and third nozzle rows are disposed at the ends of an array of the plurality of nozzle rows in the direction that crosses the nozzle rows.

7. An inkjet head comprising:

a first nozzle group including a first ejection orifice row in which a plurality of first ejection orifices for ejecting a predetermined amount of ink of a first color are arranged and a plurality of first flow paths for supplying ink from a first supply port for supplying the ink of the first color to the plurality of first ejection orifices;

a second nozzle group including a second ejection orifice row in which a plurality of second ejection orifices for ejecting an amount, larger than the predetermined amount, of the ink of the first color are arranged and a plurality of second flow paths for supplying ink from the first supply port to the plurality of second ejection orifices; and a third nozzle group including a third ejection orifice row in which a plurality of third ejection orifices for ejection an amount, larger than the predetermined amount, of ink of a second color are arranged and a plurality of third flow paths for supplying ink from a second supply port for supplying the ink of the second color to the plurality of third ejection orifices, wherein the first ejection orifice row, the second ejection orifice row and the third ejection orifice row are arranged in parallel in this order, and wherein, when A is the average cross section along a direction perpendicular to an ink supplying direction of a flow path from the supply port to the ejection orifice and L is the length of the flow path in the ink supplying direction, a value of A/L in the first nozzle group is smaller than a value of A/L in the second nozzle group and a value of A/L in the third nozzle group.

8. The inkjet head according to claim 7, wherein the first ejection orifice row is arranged on one side of the first supply port and the second ejection orifice row is arranged on the other side of the first supply port.

9. The inkjet head according to claim 7, wherein the third ejection orifice row is arranged on a side, on which the first nozzle group is formed, of the second supply port.

* * * * *